US007603997B2

(12) United States Patent
Hensel et al.

(10) Patent No.: US 7,603,997 B2
(45) Date of Patent: Oct. 20, 2009

(54) ELECTRICAL CONTROL UNIT FOR PAINTBALL GUN

(75) Inventors: Edward Hensel, Fairport, NY (US); David L. Smith, East Aurora, NY (US); Raymond S. Gaston, Lancaster, NY (US); William M. Gardner, Jr., Ligonier, PA (US); Adam Gardner, Ligonier, PA (US)

(73) Assignee: Smart Parts, Inc., Loyalhanna, PA (US)

( * ) Notice: Subject to any disclaimer, the term of this patent is extended or adjusted under 35 U.S.C. 154(b) by 0 days.

(21) Appl. No.: 11/695,406

(22) Filed: Apr. 2, 2007

(65) Prior Publication Data

US 2007/0169766 A1 Jul. 26, 2007

Related U.S. Application Data

(63) Continuation of application No. 11/480,093, filed on Jun. 29, 2006, which is a continuation of application No. 10/642,044, filed on Aug. 15, 2003, now Pat. No. 7,100,593, which is a continuation of application No. 10/254,891, filed on Sep. 24, 2002, now Pat. No. 6,637,421, which is a continuation of application No. 09/490,735, filed on Jan. 25, 2000, now Pat. No. 6,474,326, which is a continuation of application No. 08/586,960, filed on Jan. 16, 1996, now Pat. No. 6,035,843.

(51) Int. Cl.
*F41B 11/00* (2006.01)

(52) U.S. Cl. ..... 124/77

(58) Field of Classification Search ..... 124/72–77; 89/135

See application file for complete search history.

(56) References Cited

U.S. PATENT DOCUMENTS

| | | | | | |
|---|---|---|---|---|---|
| 2,116,860 | A | * | 5/1938 | Blaylock et al. | 89/1.4 |
| 2,357,951 | A | * | 9/1944 | William | 124/72 |
| 2,370,685 | A | * | 3/1945 | Wilton et al. | 178/69 A |
| 2,696,985 | A | * | 12/1954 | Hogeberg | 473/136 |
| 2,780,882 | A | | 2/1957 | Temple | |
| 2,831,402 | A | * | 4/1958 | Taslitt | 89/28.05 |
| 2,881,752 | A | * | 4/1959 | Blahnik | 124/75 |
| 2,886,025 | A | * | 5/1959 | Amistadi | 124/77 |
| 2,981,157 | A | * | 4/1961 | Marquardt | 89/135 |
| 3,011,096 | A | * | 11/1961 | Wallack et al. | 361/251 |
| 3,163,803 | A | * | 12/1964 | Luckadoo | 361/196 |

(Continued)

FOREIGN PATENT DOCUMENTS

| | | |
|---|---|---|
| JP | 60-189793 | 12/1985 |

(Continued)

*Primary Examiner*—Troy Chambers
(74) *Attorney, Agent, or Firm*—Simple IP Law, P.C.; Craig Rogers

(57) ABSTRACT

An electrical control unit preferably can control operation of a paintball gun having a solenoid valve with an input port that receives compressed gas from a compressed gas supply and an output port connected to a pneumatic mechanism. For instance, the electrical control unit can contain a network of electronic components configured to receive an input signal from a trigger-actuated switch and send a signal to the solenoid valve. The solenoid valve can, for instance, direct compressed gas to and/or from the pneumatic mechanism to operate a bolt or firing valve connected to the pneumatic mechanism in response to the signal from the electrical control unit.

20 Claims, 3 Drawing Sheets

U.S. PATENT DOCUMENTS 3,192,915 A * 7/1965 Norris et al. ..... 124/77
3,284,790 A * 11/1966 Nobles ..... 340/309.4
3,334,425 A * 8/1967 Ohlund ..... 434/16
3,451,307 A * 6/1969 Grundberg ..... 89/129.02
3,653,538 A * 4/1972 Lamar, deceased, Robert L. ..... 701/217
3,659,576 A * 5/1972 Eade et al. ..... 124/7
3,773,025 A * 11/1973 Roeder et al. ..... 124/75
3,832,612 A * 8/1974 Woods ..... 318/788
3,915,143 A * 10/1975 Waller ..... 124/77
4,004,567 A * 1/1977 Henderson ..... 124/61
4,018,684 A * 4/1977 Uffer ..... 210/140
4,148,245 A 4/1979 Steffanus et al.
4,414,610 A * 11/1983 Gale et al. ..... 362/113
4,457,091 A * 7/1984 Wallerstein ..... 42/70.11
4,510,844 A * 4/1985 Fritz et al. ..... 89/135
4,694,815 A * 9/1987 Hung ..... 124/27
4,770,153 A * 9/1988 Edelman ..... 124/72
4,793,085 A 12/1988 Surawski et al.
4,899,717 A * 2/1990 Rutten et al. ..... 124/67
4,996,787 A * 3/1991 Holcomb et al. ..... 42/7
5,063,905 A * 11/1991 Farrell ..... 124/72
5,074,189 A * 12/1991 Kurtz ..... 89/135
5,168,418 A * 12/1992 Hurley et al. ..... 361/155
5,179,235 A * 1/1993 Toole ..... 42/115
5,228,427 A * 7/1993 Gardner, Jr. ..... 124/71
5,251,906 A * 10/1993 Heller et al. ..... 273/397
5,361,700 A * 11/1994 Carbone ..... 102/439
5,396,876 A * 3/1995 Liscio et al. ..... 124/6
5,404,863 A * 4/1995 Poor ..... 124/74
5,435,091 A * 7/1995 Toole et al. ..... 42/117
5,459,957 A * 10/1995 Winer ..... 42/70.11
5,465,518 A 11/1995 Blaser
5,515,838 A * 5/1996 Anderson ..... 124/76
5,574,552 A * 11/1996 Dunne ..... 356/5.05
5,592,356 A * 1/1997 Ryl et al. ..... 361/154
5,625,972 A * 5/1997 King et al. ..... 42/84
5,703,678 A * 12/1997 Dunne ..... 356/5.05
5,881,707 A * 3/1999 Gardner, Jr. ..... 124/77
5,967,133 A * 10/1999 Gardner, Jr. ..... 124/77
6,003,504 A * 12/1999 Rice et al. ..... 124/73
6,035,843 A * 3/2000 Smith et al. ..... 124/77
6,219,952 B1 * 4/2001 Mossberg et al. ..... 42/70.01
6,430,861 B1 * 8/2002 Ayers et al. ..... 42/84
6,462,998 B1 * 10/2002 Proebsting ..... 365/205

FOREIGN PATENT DOCUMENTS

JP 3186198 8/1991
JP 6137789 5/1994
JP 07004892 A * 1/1995

* cited by examiner

ELECTRICAL CONTROL UNIT FOR PAINTBALL GUN

PRIORITY CLAIM

This application is a continuation of, and claims priority from, U.S. patent application Ser. No. 11/480,093, filed Jun. 29, 2006; which is a continuation of application Ser. No. 10/642,044 (now U.S. Pat. No. 7,100,593), filed Aug. 15, 2003; which is a continuation of U.S. patent application Ser. No. 10/254,891 (now U.S. Pat. No. 6,637,421), filed on Sep. 24, 2002; which is a continuation of, and claims priority from, U.S. patent application Ser. No. 09/490,735 (now U.S. Pat. No. 6,474,326 B1), filed Jan. 25, 2000; which is a continuation of, and claims priority from, U.S. patent application Ser. No. 08/586,960 (now U.S. Pat. No. 6,035,843), filed Jan. 16, 1996, the contents of which are herein incorporated by reference in their entirety.

FIELD OF THE INVENTION

The present invention relates generally to a pneumatically operated paintball gun ("marker") and more particularly to a control system for controlling a paintball marker.

BACKGROUND OF THE INVENTION

Guns using pneumatic force to propel a projectile are well known. In particular, it is well known to use pneumatic force to fire a fragile spherical projectile containing a colored, viscous substance (known as a "paintball") which bursts upon impact with a target. However pneumatically operated guns used in paintball applications (as well as existing pneumatically operated guns in general) suffer from several deficiencies which are eliminated by the present invention.

It is an object of the present invention to provide a projectile launching device for use in the recreational and professional sport of paintball that uses electro-pneumatic control to release the pneumatic force that propels the projectile.

SUMMARY OF THE INVENTION

The pneumatically operated projectile launching device is preferably comprised of three principal elements: a body which houses and interconnects all of the pneumatic components and also houses the electrical power source, a grip mounted to the body which can include an electrical switch that activates a launching sequence, and an electrical control unit which can be housed within both the body and a grip which directs flow between the pneumatic components to load, cock and fire the gun.

The electrical control unit preferably includes an electrical power source which activates an electrical timing circuit when the electrical switch is closed, and electrically operated pneumatic flow distribution devices (e.g., solenoid valves) which are energized by the electrical timing circuit to enable the loading of a projectile for launching and to release compressed gas from the storage chamber to fire the projectile. A projectile is fired when the electrical timing circuit actuates an electrically operated pneumatic flow distribution device to release gas from the compressed gas storage chamber into the launching mechanism.

DETAILED DESCRIPTION

A pneumatically operated paintball marker is preferably comprised of three principal elements: a body which houses and interconnects all of the pneumatic components and also houses the electrical power source; a grip mounted to the body which includes a trigger and an electrical switch that activates the launching sequence; and an electrical control unit which can be housed within the body and a grip to direct flow between the pneumatic components to load, cock and fire the marker.

Figure 2:
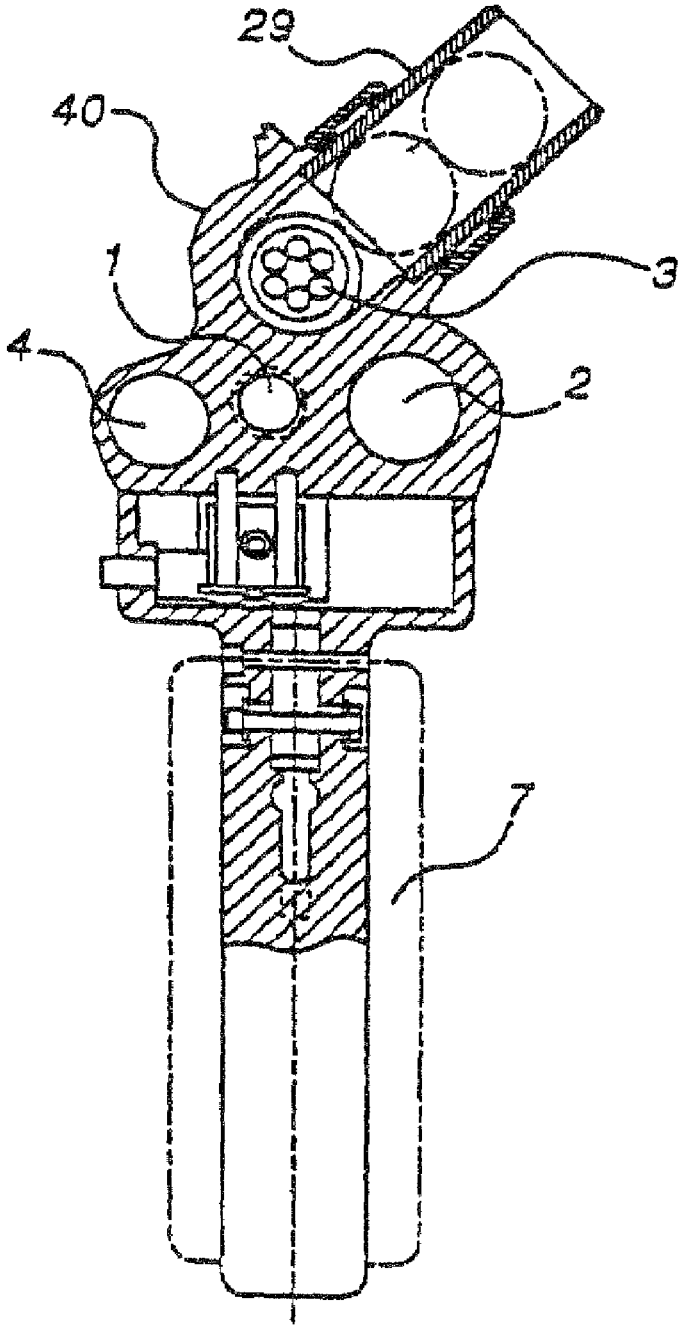
FIG. 2 is a rear view of the paintball gun of FIG. 1.

As shown in FIG. 2, the body preferably has three cylindrical pneumatic bores with axes that are preferably parallel to the longitudinal axis of the gun body 40. The gun body 40 can be made of materials suitable in the art for withstanding the force of the launching sequence such as metal or plastic. The first bore 1 contains compressed gas and is preferably sealed by a removable fitting 5 which is removed to inject the gas. The first bore 1 is preferably in communication with the second bore 2 and the third bore 3 through a series of ported passageways 6*a* and 6*b*, respectively, bored through the interior of the gun body 40.

Figure 1:
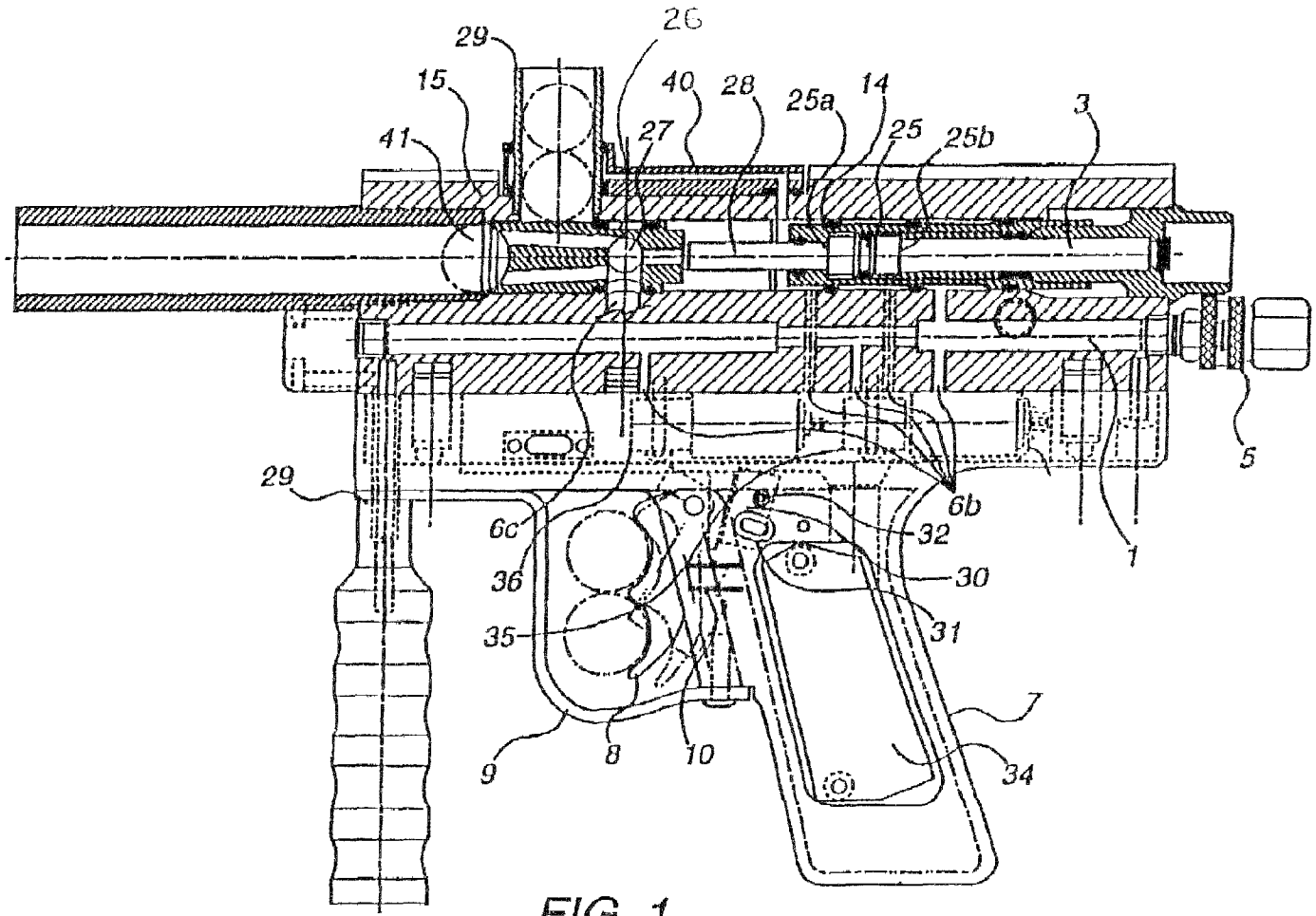
FIG. 1 is a cross-sectional side view of a paintball gun, according to one embodiment of the present invention.
Figure 3:
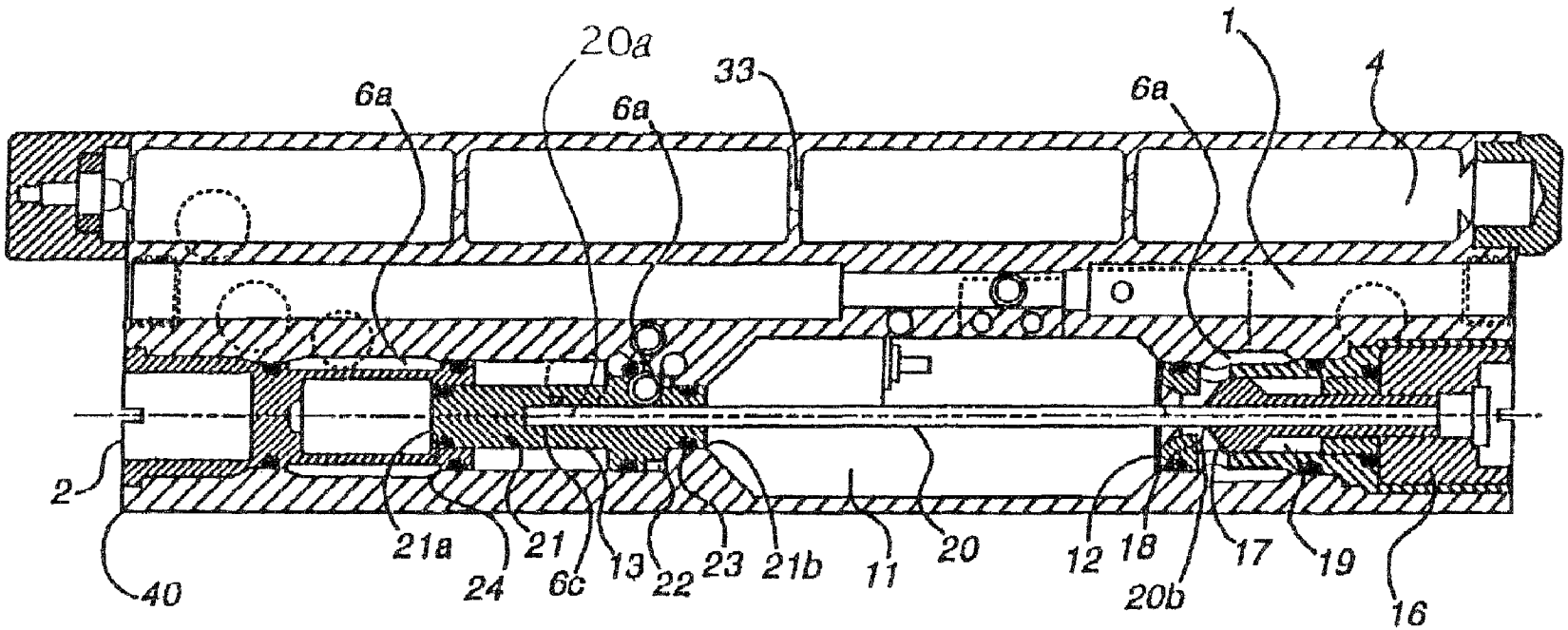
FIG. 3 is a cross-sectional top view of the body of the paintball gun of FIG. 1.

As shown in FIG. 3, the second bore 2 houses the compressed gas storage chamber 11, the compressed gas filling mechanism 12 and the compressed gas releasing mechanism 13. The third bore 3 is also preferably in communication with both the first bore 1 and the second bore 2 through a series of ported passageways 6*b* and 6*c*, respectively, bored through the interior of the gun body 40. As shown in FIG. 1, the third bore 3 houses the projectile loading mechanism 14 and the projectile launching mechanism 15.

As shown in FIG. 3, the compressed gas storage chamber 11 is bordered by the interior walls of the second bore 2 and by the compressed gas filling mechanism 12 on one end and by the Compressed gas releasing mechanism 13 on the end opposite the compressed gas filling mechanism 12. The compressed gas storage chamber 11 is filled with compressed gas from the first bore 1 by means of the interconnections 6*a* between the first bore 1 and the second bore 2 when the compressed gas filling mechanism 12 is actuated. The compressed gas storage chamber 11 releases stored gas to the projectile launching mechanism 15 by means of the interconnections 6*c* between the second bore 2 and the third bore 3 when the compressed gas releasing mechanism 13 is actuated.

As shown in FIG. 3, the compressed gas filling mechanism 12 preferably consists of a valve 16 with a metallic or plastic conically or spherically shaped plug 17 which is normally shut against a metallic, plastic, or rubber conically or concavely shaped seat 18 by the loading of a spring 19 when the compressed gas filling mechanism 12 is not in its actuated position. The plug 17 is attached to a second end 20*b* of a metallic or plastic rod-shaped mechanical linkage 20 which opens the valve 16 by compressing the spring 19 when the compressed gas filling mechanism 12 is in its actuated position to create a flow path for compressed gas from the first bore 1 to the compressed gas storage chamber 11.

As shown in FIG. 3, the mechanical linkage 20 passes through the compressed gas storage chamber 11 and has a first end 20*a* which is attached to the compressed gas releasing mechanism 13. The compressed gas releasing mechanism 13 preferably consists of a metallic or plastic cylindrical piston 21 which slides along the longitudinal axis of the second bore 2 in a space adjacent to the compressed gas storage chamber 11. A second end 21*b* of the piston 21 is adjacent to the compressed gas storage chamber 11 and is connected to the first end 20*a* of the mechanical linkage 20. The second end of the piston 21*b* has a flexible O-ring seal 23 made of rubber or other suitable synthetic sealing materials such as polyurethane that prevents gas leakage out of the compressed gas storage chamber 11. Compressed gas from the first bore 1 is applied to the second end of the piston 2*db* to actuate the compressed gas releasing mechanism 13 by unseating the O-ring 23 sealing the compressed gas storage chamber 11 to allow stored gas to be released from the compressed gas storage chamber 11 into the projectile launching mechanism 15 by means of the interconnections 6*c* between the second bore 2 and the third bore 3. The piston 21 contains a notched area 22 adjacent to the O-ring 23 that provides a surface for applying compressed gas pressure from the first bore 1 to unseat the O-ring 23 and actuate the compressed gas releasing mechanism 13.

The piston 21 has a first end 21*a* opposite the compressed gas storage chamber 11 which is subjected to pneumatic pressure to actuate the compressed gas filling mechanism 12 by transmitting through the mechanical linkage 20 a compression force on the spring 19 that opens the valve 16. The opening in the valve 16 is formed when the plug 17 is separated from the seat 18 to create a flow path for compressed gas from the first bore 1 to the compressed gas storage chamber 11 by means of the interconnections 6*a* between the first bore 1 and the second bore 2. Compressed gas from the first bore 1 is applied to the first end of the piston 2*da* to open the valve 15 and actuate the compressed gas filling mechanism 12. The first end of the piston 21*a* also contains a flexible O-ring seal 24 which prevents 20 actuating pressure leakage into the compressed gas storage chamber 11 when the compressed gas filling mechanism 12 is actuated.

As shown in FIG. 1, the third bore 3 of the gun body 40 houses the projectile loading mechanism 14 and the projectile launching mechanism 15. The projectile loading mechanism 14 preferably consists of a metallic or plastic cylindrical piston 25 which slides along the longitudinal axis of the third bore 3. The projectile launching mechanism 15 preferably consists of a metallic or plastic cylindrical bolt 26 which also slides along the longitudinal axis of the third bore 3 and which has a port 27 for receiving released gas from the compressed gas storage chamber 11 to propel a projectile 41 from the gun body 40. The bolt 26 is connected to the piston 25 by a metallic or plastic rod-shaped mechanical linkage 28, which moves the bolt 26 to receive the projectile 41 by gravity loading from the projectile feed mechanism 29 when the projectile loading mechanism 14 is actuated.

The projectile loading mechanism 14 is actuated when compressed gas from the first bore 1 is applied by means of the interconnections 6*b* between the first bore 1 and the third bore 3 to a first end 25*a* of the piston 25 which is attached to the mechanical linkage 28. This compressed gas acts against the piston 25 and the mechanical linkage 28 to drive the bolt 26 back to the cocked position which enables the loading of a projectile 41 into engagement with the bolt 26 from the projectile feed mechanism 29. The subsequent release of stored gas from the compressed gas storage chamber 11 through the bolt port 27 will drive the projectile 41 from the gun body 40. After the launching sequence has been completed compressed gas is applied from the first bore 1 to a second end 25*b* of the piston 25 opposite the mechanical linkage 25 to disable the bolt 26 from receiving a projectile 41 by driving the bolt 26 to the shut position. The second principal element is a grip, for instance as shown in FIG. 1. The grip is mounted to the body and preferably houses three principal components, a handle 7, a trigger S and an electrical switch 30. The handle 7 can be made of any suitable material such as metal or plastic and is preferably shaped with a hand grip to allow the gun to be held in a pistol-like fashion. The metallic or plastic trigger 8 is attached to the handle 7 and preferably has a leading edge shaped to be pulled by two fingers with a cam shaped trailing edge to engage the electrical switch 30. A trigger guard 9 which prevents accidental trigger displacement is preferably attached to the trigger 8. A spring 10 preferably returns the trigger 8 to a neutral position after the electrical switch 30 has been contacted to initiate a launching sequence. The electrical switch 30 is preferably a two-pole miniature switch which contains a plunger 31 loaded by a spring 32.

As shown in FIG. 1, the third principal element is an electrical control unit which is housed within both the body and the grip. The electrical control unit preferably consists of an electrical timing circuit 34 housed in the handle 7 along with two electrically operated 3-way solenoid valves 35 and 36 housed in the gun body 40 and an electrical battery power source 33 housed in a fourth bore 4 of the gun body 40. The electrical timing circuit 34 is preferably a network of electronic components that can include two solid state integrated circuit timers which control the launching sequence by sending energizing pulses to the solenoid valves 35 and 36 which function as electrically operated pneumatic flow distribution mechanisms. When actuated the solenoid valves 35 and 36 pass compressed gas flow from the first bore 1 and when not actuated the solenoid valves 35 and 36 operate to vent gas from the pressurized area. Upon initiation of the launching sequence the electrical timing circuit 34 energizes each solenoid valve 35 or 36 separately in a timed sequence to ensure that each solenoid valve 35 or 36 either passes or vents pressurized gas at the appropriate time within the launching sequence to propel a projectile 41 from the gun body 40.

DETAILED DESCRIPTION OF OPERATION

Referring to FIGS. 1-3, before the initiation of a launching sequence the introduction of compressed gas into the first bore 1 will preferably automatically cause pneumatic pressure to be applied to the first end of piston 21*a* to cause gas flow from the first bore 1 to the compressed gas storage chamber 11 through actuation of the compressed gas filling mechanism 12 as described above. Simultaneously pneumatic pressure will preferably automatically be applied to the second end of piston 25*b* driving the bolt 26 to the shut position to disable the loading of a projectile 41. When these conditions are met the compressed gas storage chamber 11 is charged with the bolt 26 closed and the gun is ready for the initiation of a launching sequence.

A launching sequence is preferably initiated when the electrical switch 30 completes a circuit between the electrical power source 33 and the electrical timing circuit 34 as the cam shaped trailing edge of the trigger 8 contacts the plunger 31 to compress the spring 32. When contact is made the electrical power source 33 energizes the electrical timing circuit 34 which first sends an energizing pulse to actuate the first solenoid valve 35. When actuated the first solenoid valve 35 passes pressurized gas flow to the first end of piston 25*a* to actuate the projectile loading mechanism 14 by driving the bolt 26 back to the cocked position and to enable the loading of a projectile 41 into engagement with the bolt 26 from the projectile feed mechanism 29.

Before the launching sequence is completed, pneumatic pressure is again preferably automatically applied to the second end of piston 25*b* to drive the bolt 26 shut. The electrical timing circuit 34 then sends an energizing pulse to actuate the second solenoid valve 36 which then passes pressurized gas flow to the second end of piston 21*b* to actuate the compressed gas releasing mechanism 13. Simultaneously, the first solenoid valve 35 returns to its non-actuated position to vent the first end of piston 25*a*. This venting in combination with the actuation of the compressed gas releasing mechanism 13 allows the stored gas released into the bolt port 27 from the compressed gas storage chamber 11 to drive the projectile 41 from the gun body 40. Following the launching sequence, pneumatic pressure is again preferably automatically applied to the first end of piston 21*a* to actuate the compressed gas filling mechanism 12 to re-pressurize the compressed gas storage chamber 11.

The volume of the compressed gas storage chamber 11 and the bore interconnections 6 are preferably sized to produce projectile velocities in the 290 to 300 feet per second range at an operating gas pressure of approximately 125 pounds per square inch gauge pressure. However, the 1.5 cubic inch volume of the compressed gas storage chamber 11 and the 0.0315 square inch area of the bore interconnection orifices 6 will allow operation of the preferred embodiment at gas pressures of up to 175 pounds per square inch gauge pressure. As will be obvious to one skilled in the art, these parameters may be varied in order to allow for a differing operating gas pressure or projectile velocity.

While presently preferred embodiments have been shown and described in particularity, the invention may be otherwise embodied within the scope of the appended claims.

The invention claimed is:

1. An electrical control unit for a pneumatic gun that applies a pneumatic force through a bolt to a projectile to launch it from the pneumatic gun, said pneumatic gun comprising a solenoid valve that directs compressed gas through the solenoid valve to a pneumatic piston to open the bolt during operation of the pneumatic gun, said electrical control unit comprising:

a power supply connection that receives power from a power supply arranged in the pneumatic gun;

an electrical timing circuit that receives electrical power from the power supply, and outputs signals to the solenoid valve in the pneumatic gun in a timed sequence that is adapted to control a launching sequence of the pneumatic gun; and wherein said electrical timing circuit sends a signal to the solenoid valve, said signal having a sufficient duration to direct a flow of compressed gas through the solenoid valve to the pneumatic piston in a sufficient quantity to open the bolt and load a projectile into the pneumatic gun, wherein said bolt is further configured to supply a quantity of compressed gas through the bolt to the projectile to launch said projectile from the pneumatic gun during a firing operation.

2. An electrical control unit according to claim 1, wherein the pneumatic gun comprises a second pneumatic piston coupled to a firing valve to control the firing operation of the pneumatic gun, wherein the electrical timing circuit sends a firing signal to operate the second pneumatic piston, and wherein the duration and timing of the firing signal allows the compressed gas sufficient time to act on the pneumatic piston to operate the firing valve.

3. An electrical control unit according to claim 1, wherein a pneumatic piston is coupled to a firing valve to control a firing operation of the pneumatic gun, and wherein the duration and timing of a firing signal from the electrical timing circuit provides sufficient time to operate a firing mechanism of the pneumatic gun.

4. An electrical control unit according to claim 1, wherein the solenoid valve is a three-way solenoid valve, and wherein the signal from the electrical timing circuit actuates the solenoid valve.

5. An electrical control unit according to claim 1, wherein said electrical control unit is at least, partly arranged on a circuit board, wherein said circuit board is sized and configured to fit within a grip of the pneumatic gun.

6. An electrical control unit according to claim 3, further comprising a trigger-actuated switch positioned to be contacted by a trigger of the pneumatic gun and configured to initiate the firing operation of the pneumatic gun in response to a trigger pull.

7. An electrical control unit according to claim 1, wherein the electrical control unit is further configured to send a signal to the solenoid valve to vent compressed gas from the piston through the solenoid valve.

8. An electrical control unit according to claim 3, wherein compressed gas from the solenoid valve causes the firing valve to open, and wherein the signal duration is sufficient to cause the firing valve to open.

9. An electrical control unit according to claim 1, wherein the electrical timing circuit comprises a network of electronic components that control a launching sequence by sending one or more energizing pulses to the solenoid valve, wherein said energizing pulses are of a sufficient duration and sequenced to control the solenoid valve to operate the pneumatic gun.

10. An electrical control unit according to claim 9, wherein the pneumatic gun comprises a plurality of solenoid valves and wherein the electrical timing circuit sends electrical signals to the solenoid valves in a timed sequence to operate the pneumatic gun.

11. An electrical control unit for controlling operation of a paintball gun, comprising:

an electronic circuit board sized and shaped to mount within the paintball gun; and a timing circuit arranged on the electronic circuit board and configured, to send one or more timed signals to one or more solenoid valves arranged in the paint ball gun, wherein said one or more solenoid valves direct compressed gas through the one or more solenoid valves to one or more pneumatic mechanisms to operate a bolt and a firing valve of the paintball gun.

12. An electrical control unit according to claim 11, wherein the electrical timing circuit comprises a network of electronic components that control a launching sequence of the paintball gun by sending one or more energizing pulses to the one or more solenoid valves.

13. An electrical control unit according to claim 11, wherein the electronic circuit board is sized and shaped to mount within a grip of the paintball gun.

14. An electrical control unit according to claim 11, further comprising an electrical switch configured to be actuated in response to a trigger pull of the paintball gun, wherein the timing circuit generates the one or more timed signals in response to actuation of the electrical switch.

15. An electrical control unit according to claim 11, wherein the timing circuit controls a firing operation of the paintball gun by causing one of the one or more solenoid valves to direct compressed gas through the solenoid valve to one of the one or more pneumatic mechanisms coupled to the firing valve to drive the firing valve to an open position.

16. An electrical control unit for controlling one or more operations of an electronic pneumatic gun, said electrical control unit comprising:

a power supply connection for receiving power from an electrical power supply arranged in the pneumatic gun; and an electrical timing circuit located within a grip of the pneumatic gun when operably arranged within the pneumatic gun, said timing circuit receiving power from the electrical power supply and sending timing signals to a solenoid to control a firing sequence that causes a compressed gas to launch a projectile from the pneumatic gun during operation of the pneumatic gun.

17. An electrical control unit according to claim 16, wherein the electrical timing circuit comprises a network of electronic components that generate and transmit the timing signals to the solenoid.

18. An electrical control unit, according to claim 16, wherein said solenoid operates a solenoid valve to convey the compressed gas to a pneumatic piston to drive a bolt.

19. An electrical control unit according to claim 16, wherein said solenoid operates a solenoid valve to convey the compressed gas to a pneumatic piston to drive a firing valve.

20. An electrical control unit according to claim 19, wherein the pneumatic piston is coupled to the firing valve.

* * * * *

US007603997C1

(12) EX PARTE REEXAMINATION CERTIFICATE (10700th)

United States Patent
Hensel et al.

(10) Number: US 7,603,997 C1
(45) Certificate Issued: Sep. 4, 2015

(54) ELECTRICAL CONTROL UNIT FOR PAINTBALL GUN

(75) Inventors: Edward Hensel, Fairport, NY (US); David L. Smith, East Aurora, NY (US); Raymond S. Gaston, Lancaster, NY (US); William M. Gardner, Jr., Ligonier, PA (US); Adam Gardner, Ligonier, PA (US)

(73) Assignee: KEE ACTION SPORTS, LLC., Sewell, NJ (US)

Reexamination Request:
No. 90/013,306, Aug. 11, 2014

Reexamination Certificate for:

| | |
|---|---|
| Patent No.: | **7,603,997** |
| Issued: | **Oct. 20, 2009** |
| Appl. No.: | **11/695,406** |
| Filed: | **Apr. 2, 2007** |

Related U.S. Application Data

(63) Continuation of application No. 11/480,093, filed on Jun. 29, 2006, now Pat. No. 7,610,908, which is a continuation of application No. 10/642,044, filed on Aug. 15, 2003, now Pat. No. 7,100,593, which is a continuation of application No. 10/254,891, filed on Sep. 24, 2002, now Pat. No. 6,637,421, which is a continuation of application No. 09/490,735, filed on Jan. 25, 2000, now Pat. No. 6,474,326, which is a continuation of application No. 08/586,960, filed on Jan. 16, 1996, now Pat. No. 6,035,843.

(51) Int. Cl.

| | |
|---|---|
| ***F41B 11/00*** | (2013.01) |
| ***F41B 11/70*** | (2013.01) |
| ***F41B 11/71*** | (2013.01) |
| ***F41B 11/52*** | (2013.01) |
| ***F41B 11/721*** | (2013.01) |

(52) U.S. Cl.
CPC ..... *F41B 11/52* (2013.01); *F41B 11/721* (2013.01)

(58) Field of Classification Search
None
See application file for complete search history.

(56) References Cited

To view the complete listing of prior art documents cited during the proceeding for Reexamination Control Number 90/013,306, please refer to the USPTO's public Patent Application Information Retrieval (PAIR) system under the Display References tab.

*Primary Examiner* — Jeffrey R Jastrzab

(57) ABSTRACT

An electrical control unit preferably can control operation of a paintball gun having a solenoid valve with an input port that receives compressed gas from a compressed gas supply and an output port connected to a pneumatic mechanism. For instance, the electrical control unit can contain a network of electronic components configured to receive an input signal from a trigger-actuated switch and send a signal to the solenoid valve. The solenoid valve can, for instance, direct compressed gas to and/or from the pneumatic mechanism to operate a bolt or firing valve connected to the pneumatic mechanism in response to the signal from the electrical control unit.

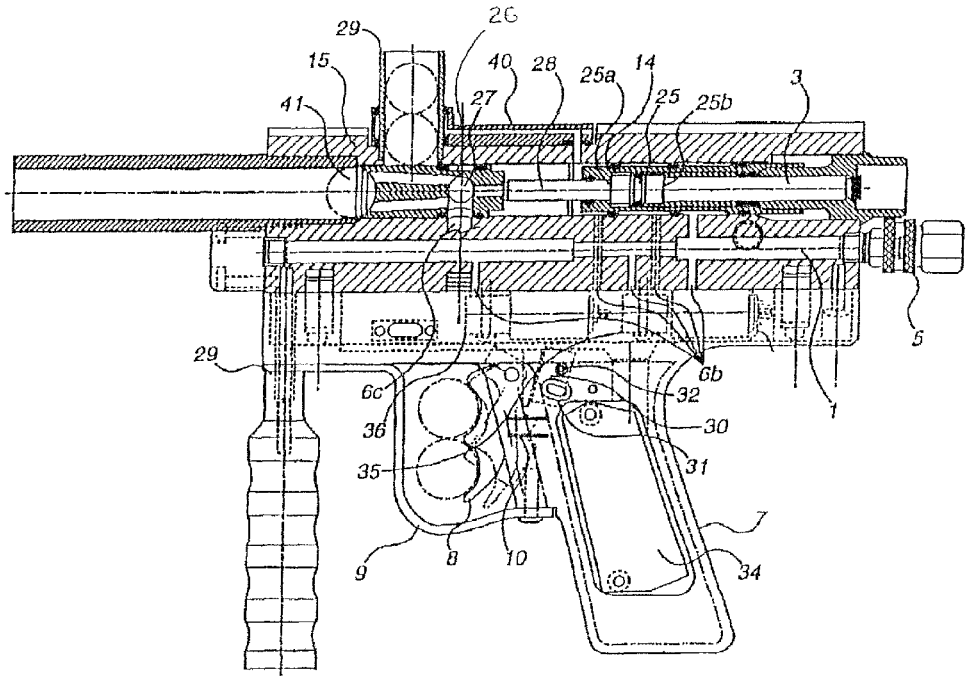

EX PARTE REEXAMINATION CERTIFICATE

NO AMENDMENTS HAVE BEEN MADE TO THE PATENT

AS A RESULT OF REEXAMINATION, IT HAS BEEN DETERMINED THAT:

The patentability of claims 1-20 is confirmed.

* * * * *